United States Patent [19]

Ikuma et al.

[11] Patent Number: 4,821,249

[45] Date of Patent: Apr. 11, 1989

[54] TIMEPIECE MOVEMENT

[75] Inventors: Susumu Ikuma; Nobuhiro Tanaka, both of Tokyo, Japan

[73] Assignee: Seikosha Co., Ltd., Tokyo, Japan

[21] Appl. No.: 174,834

[22] Filed: Mar. 29, 1988

[30] Foreign Application Priority Data

Mar. 30, 1987 [JP] Japan ..... 62-47217[U]

[51] Int. Cl.[4] ..... G04C 23/02; G04C 3/00

[52] U.S. Cl. ..... 368/88; 368/204

[58] Field of Search ..... 368/76, 80, 88, 203, 368/204, 276, 220, 223, 299–300

[56] References Cited

U.S. PATENT DOCUMENTS

| | | | |
|---|---|---|---|
| 4,223,521 | 9/1980 | Saitoh et al. | 368/204 |
| 4,241,439 | 12/1980 | Skwarec | 368/204 |
| 4,251,604 | 2/1981 | Umemoto | 368/204 |
| 4,351,040 | 9/1982 | Aoki | 368/88 |

FOREIGN PATENT DOCUMENTS

| | | | |
|---|---|---|---|
| 3518511 | 1/1987 | Fed. Rep. of Germany | 368/204 |

*Primary Examiner*—Vit W. Miska

*Attorney, Agent, or Firm*—Bruce L. Adams; Van C. Wilks

[57] ABSTRACT

A timepiece movement has a case in which are mounted a driving motor, a gear train driven by the motor, a printed circuit board having a driving circuit for driving the motor, and a battery accommodating portion for replaceably receiving a battery. A pair of battery contacts for electrically connecting the battery to the printed circuit board are provided on the outer surface of the case. One end of each of the battery contacts extends through an opening in the case to make elastic contact with the battery, and the other end of each of the battery contacts extends through another opening in the case to make elastic contact with the printed circuit board.

7 Claims, 2 Drawing Sheets

TIMEPIECE MOVEMENT

BACKGROUND OF THE INVENTION

1. Field of the Invention

This utility model relates to a timepiece movement.

2. Description of the Prior Art

In a conventional timepiece movement, a movement case comprising an upper case and a lower case accommodates a driving motor comprising a stator and a rotor, a gear train which is driven by the driving motor, a printed circuit board in which a driving circuit for the driving motor is arranged, a battery accommodating portion for accommodating a battery, and a pair of battery contacts for supplying energy from the battery to the printed circuit board.

In the above prior art, the above described driving motor and so on are assembled in the movement case, and the battery is mounted in the battery accommodating portion. Thereafter, various inspections such as one for examining alarm signals and one for the driving signals for the motor are carried out. During these inspections, an inspection terminal of a measuring apparatus must be inserted into a narrow gap of the battery accommodating portion and brought into contact with both plus and minus contacts of the battery, for the purpose of taking the aforementioned signals. This work has therefore been very difficult.

An object of the present invention, therefore, is to facilitate the carrying out of inspection of the timepiece movement after it has been assembled.

This invention is characterized in that a pair of battery contacts are provided on the outer surface of the movement case, and that one end of each of the battery contacts is capable of coming into elastic contact with the battery accommodated in a battery accommodating portion through a first opening bored in the movement case, and that the other end of each of the battery contacts is in elastic contact with a printed circuit board through a second opening bored in the movement case.

According to the present invention, since the greater part of the pair of contacts of the battery appears on the outside surface of the movement case after the timepiece movement has been assembled, the plus and minus inspection terminals of the measuring apparatus can be brought into contact with the wide exposed area of each of the battery contacts for the purpose of taking required signals.

BRIEF DESCRIPTION OF THE DRAWINGS

The accompanying drawings illustrate an embodiment of the present utility model, wherein.

DESCRIPTION OF THE PREFERRED EMBODIMENT

An embodiment of the present invention will now be described with reference to the accompanying drawings.

Figure 1:
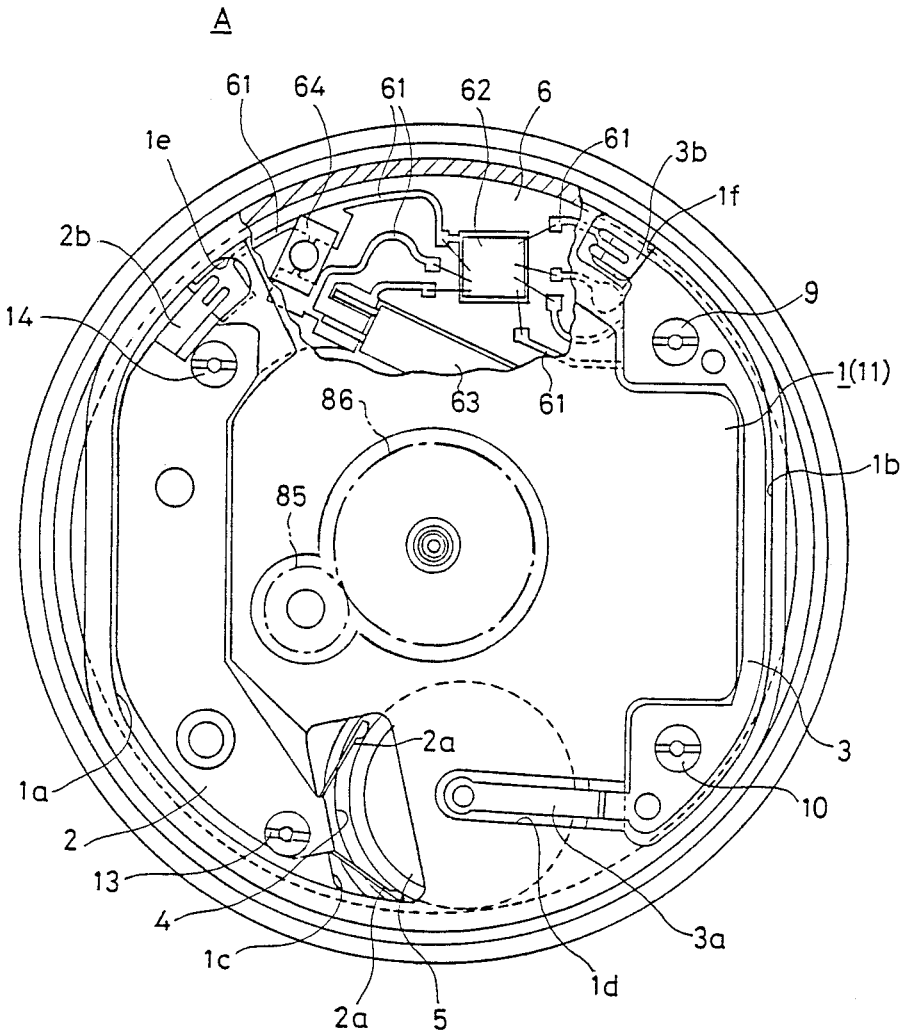
FIG. 1 is a front view which a part is omitted.
Figure 2:
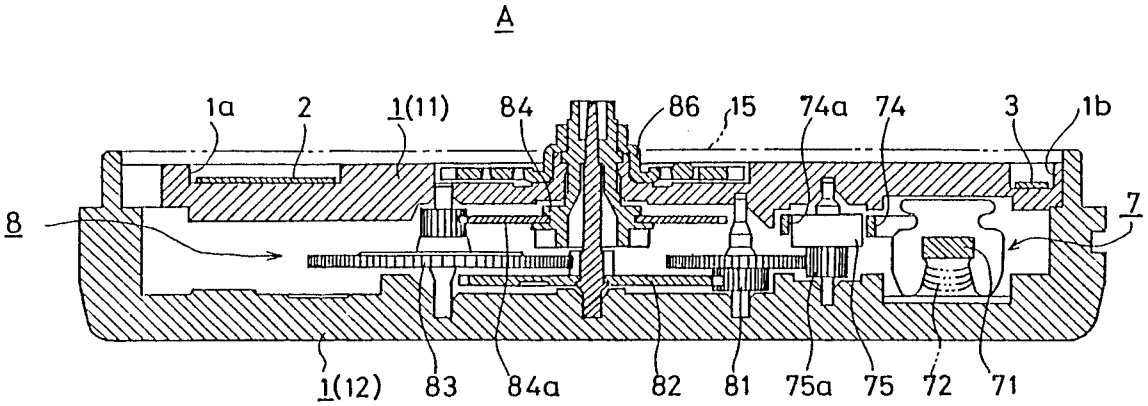
FIGS. 2 and 3 are exploded cross-sectional views for illustrating the essential portion.
Figure 3:
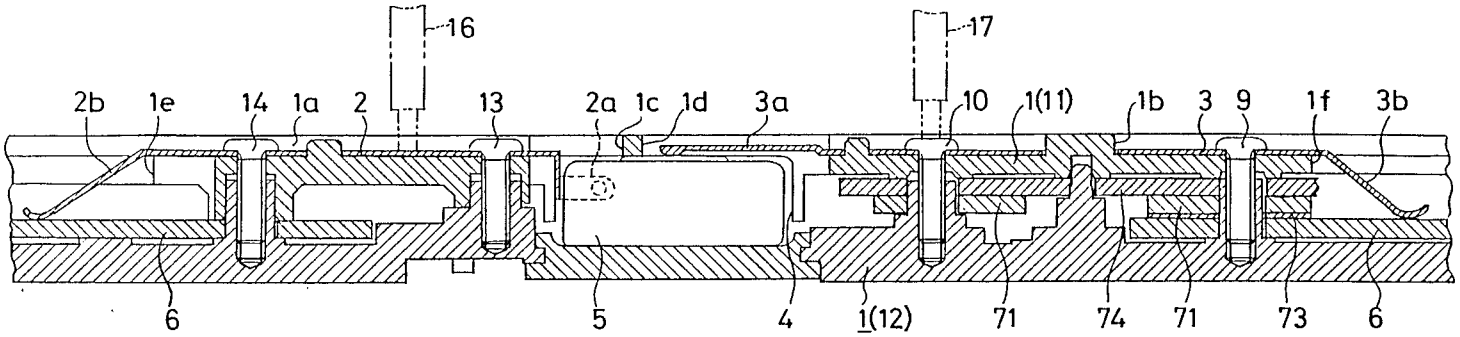

As shown in FIGS. 2 and 3, a timepiece movement. A comprises a movement case 1 consisting of a lower case 11 and an upper case 12, and a driving mechanism such as a gear train 8 which is mounted therebetween. As shown in FIG. 1, recesses 1*a* and 1*b* are provided in the outer surface of the lower case 11 of the movement case 1. A pair of plus and minus battery contacts 2 and 3 is respectively provided in the corresponding recesses. The respective ends 2*a* and 3*a* of the battery contacts 2 and 3 are inserted into the timepiece movement A through the corresponding first openings 1*c* and 1*d* bored in the lower case 11. A battery accommodating portion 4 is disposed in the timepiece movement A. Each of the ends 2*a* and 3*a* are capable of coming into contact with the corresponding plus and minus terminal of the battery 5 accommodated in the battery accommodating or battery-receiving portion 4. The other ends 2*b* and 3*b* of the battery contacts 2 and 3 are inserted into the timepiece movement A through second openings 1*e* and 1*f* bored in the lower case 11. A printed circuit board 6 is disposed in the timepiece movement A. the other ends 2*b* and 3*b* are in elastic contact with predetermined portions in a circuit pattern 61 arranged on the printed circuit board 6.

As shown in FIGS. 2 and 3, a timekeeping means comprising driving motor 7 and a gear train 8 are installed in the space between the lower case 11 and the upper case 12. That is, a driving coil 72 (see FIG. 2) is wound around a coil core 71. The two ends of the driving coil 72 are connected to a coil terminal plate 73 (see FIG. 3). The upper surfaces of the two ends of the coil core 71 are overlaid with the two ends of the stator 74. As shown in FIG. 3, a coil terminal plate 73 is positioned so as to be in contact with the printed circuit board 6 on which is arranged a driving circuit for the driving motor 7 so as to be connected to a predetermined position in a circuit pattern 61 (see FIG. 1). This connected portion is overlaid with another end of the coil core 71 and another end of the stator 74 and a portion in the vicinity of the other end of the minus contact 3 of the battery through the lower case 11. The above overlaid portions are fastened by a screw 9 to the upper case 12. The portion in the vicinity of the battery contact 3 is overlaid with one end of the stator 74 and one end of the coil core 71 through the lower case 11, and the overlaid portions are fastened to the upper case 12 by a screw 10. As shown in FIG. 2, a rotor 75 is disposed in a hole 74*a* in the intermediate portion of the stator 74. A gear train 8 is arranged to be driven by the rotor pinion 75*a*. That is, a driving wheel 81, a second wheel 82, an intermediate wheel 83, and a minute wheel 84*a* are sequentially engaged with the rotor pinion 75*a*. The center wheel 84*a* is secured to a minute wheel pipe 84 which is integrally formed with a minute wheel pinion through a slip mechanism (not shown). A transmission wheel 85 shown in FIG. 1 is engaed with the minute wheel pinion, and a hour wheel 86 is engaged with a minute wheel pinion which appears on the outer surface of the lower case 11. As shown in FIG. 3, the portion in the vicinity of one end of the plus ends of the battery contact 2 is secured to the lower case 11 and the upper case 12 by a screw 13, while the portion in the vicinity of the other end of the battery contact 2 is secured to the lower case 11, printed circuit 6, and upper case 12 by a screw 14.

As shown in FIG. 1, the driving circuit for the driving motor 7 is arranged on the printed circuit board 6, an integrated circuit 62 and a crystal oscillator 63 and a capacitor 64 are connected to the corresponding predetermined positions in the circuit pattern 61. Reference numeral 15 shown in FIG. 2 represents a dial disposed on the outside of the lower case 11.

A battery 5 is accommodated in a battery accommodating portion 4 of the timepiece movement A which has been assembled as described above. Therefore, a plus inspection terminal 16 of the measuring apparatus is, as shown in FIG. 3, brought into contact with a surface on which the plus contact 2 of the battery appears or the screws 13 or 14, while a minus inspection terminal 17 of the measuring apparatus is brought into contact with a surface on which the minus contact 3 of the battery appears or the screws 9 or 10. In such a manner, the required signals such as alarm signals or motor driving signals can be taken for the purpose of carrying out the inspection.

As described above, in an timepiece movement according to the present invention, since the battery contacts appear broadly after assembly has been completed, the inspection terminals of a measuring apparatus can be significantly easily brought into contact with the battery contacts. Consequently, accurate data can be easily obtained, whereby precise in can be improved.

What is claimed is:

1. A timepiece movement comprising:

a movement case containing therein a driving motor comprising a stator and a rotor, a gear train driven by said driving motor, a printed circuit board having a driving circuit for said driving motor, and a battery accommodating portion for accommodating a battery during use of the timepiece movement;

a pair of battery contacts for supplying energy from said battery to said printed circuit board and being provided on the outer surface of said case;

one end of each of said battery contacts being capable of elastically contacting said battery through a first opening in said case; and the other end of each of said battery contacts being in elastic contact with said printed circuit board through a second opening in said case.

2. A timepiece movement comprising: a case having means therein defining a battery-receiving portion for replaceably receiving a battery during use of the timepiece movement; timekeeping means including a printed circuit board mounted within the case for keeping time; and a pair of battery contacts disposed along an outer surface of the case for electrically connecting the printed circuit board to the battery, each battery contact having one end elastically contactable with the battery through a first opening in the case and having another end in elastic contact with the printed circuit board through a second opening in the case.

3. A timepiece movement according to claim 2; wherein the case comprises upper and lower case sections which define therebetween the battery-receiving portion.

4. A timepiece movement according to claim 3; wherein the battery contacts extend along the outer surface of the lower case section adjacent to the periphery thereof.

5. A timepiece movement according to claim 4; wherein the first openings and the second openings are provided in the lower case section.

6. A timepiece movement according to claim 5; wherein the timekeeping means comprises a gear train, a rotary driving motor for driving the gear train, and a driving circuit mounted on the printed circuit board for rotationally driving the driving motor.

7. A timepiece movement according to claim 2; wherein the timekeeping means comprises a gear train, a rotary driving motor for driving the gear train, and a driving circuit mounted on the printed circuit board for rotationally driving the driving motor.

* * * * *